US005106096A

United States Patent [19]

Dunn

[11] Patent Number: 5,106,096

[45] Date of Patent: Apr. 21, 1992

[54] GOLF BALL

[75] Inventor: Steven B. Dunn, Santa Ana, Calif.

[73] Assignee: Bullet Golf Ball, Inc., Santa Ana, Calif.

[21] Appl. No.: 702,248

[22] Filed: May 17, 1991

[51] Int. Cl.[5] ..... A63B 37/14

[52] U.S. Cl. ..... 273/232; 273/183 C

[58] Field of Search ..... 273/232, 213, 183 C; 40/327; D21/205

[56] References Cited

U.S. PATENT DOCUMENTS

D. 73,046 7/1927 Penfold ..... D21/205

4,869,512 9/1989 Nomura et al. ..... 273/232

*Primary Examiner*—George J. Marlo

*Attorney, Agent, or Firm*—Edward A. Sokolski

[57] ABSTRACT

A golf ball has dimples formed on its surface which are in a pattern covering the entire surface and which has square dimples and round dimples which are interspersed with each other in a generally uniform manner. This end result is achieved by arranging most of the dimples in circles which run around the ball and with alternate round and square dimples. A first group of the circles run parallel to each other and a second group of the circles run parallel to each other with the circles of the first group being substantially perpendicular to those of the second group. So as to completely cover the surface of the ball with dimples, the uniform alternate round and square dimple pattern is necessarily interrupted at several placed. About 432 dimples are placed on the surface of the ball for optimum aerodynamic effect.

3 Claims, 1 Drawing Sheet

GOLF BALL

BACKGROUND OF THE INVENTION

1. Field of the Invention

This invention relates to golf balls and more particularly to a golf ball having a dimple pattern in which square and round dimples are interspersed in a substantially uniform manner over the entire surface of the ball.

2. Description of the Related Art

Dimples have been placed on the surface of golf balls for many years to provide improved aerodynamic characteristics to the ball which lessens drag and enables the ball to travel further. While round dimples have generally been used in view of the lower drag which it was expected would result therefrom, as compared with that resulting from the sharp edges of square or truncated pyramid shaped dimples, there have in the past been balls utilizing square dimples. An Eagle ball used in 1925 had all square dimples while a Warwick ball of the era of 1935 had a combination of round and square dimples. In the Warwick ball, the square and round dimples were arranged in a pattern including separate circles having predominantly square or round dimples but the round and square dimples were not alternated or interspersed substantially uniformly over the surface of the ball.

Golf balls using special dimple patterns directed to improved aerodynamic characteristics are described in U.S. Pat. No. 4,142,727 issued on Mar. 6, 1979 to Shaw et.al. and U.S. Pat. No. 4,560,168 issued Dec. 24, 1985 to Aoyama. In neither of these patents is the use of other than round dimples described.

BRIEF SUMMARY OF THE INVENTION

The ball of the present invention has round and square dimples formed on the surface thereof, such dimples being interspersed in a substantially uniform pattern. Circles of such dimples have alternate round and square dimples. A first group of such circles are substantially parallel to each other, this first group of circles being substantially perpendicular to a second group of such circles which are also substantially parallel to each other. To enable complete coverage of the surface of the ball with dimples, this uniform pattern is interrupted in several spots by several groups of adjacent round and/or square dimples which are located in the centers of spherical triangles into which the surface of the ball can be divided.

The square dimples have straight sides which provide a striking surface to the ball which facilitates imparting backspin thereto. In order to ensure that the club face would always strike a portion of the ball having square dimples, such square dimples are distributed in as generally uniform fashion over the entire ball surface. The round dimples with their generally uniform distribution assure that the ball has good aerodynamic characteristics for proper flight. It has been found that while most golf balls have about 360 dimples that better aerodynamic characteristics can be achieved with 380–540 dimples. A preferred embodiment of the the ball of the present invention has 432 dimples which has been found to be optimum where a combination of square and round dimples is employed, as in the device of this invention.

It has been found that the sharp edges of the square dimples do not impede the early high velocity stages of flight, as much as might be expected. During later lower velocity stages of flight, however, the square dimples contribute to turbulence so as to cause the ball to descend at a shallower angle which causes greater roll of the ball on the ground and a net overall greater distance.

It is therefore an object of this invention to provide a golf ball which facilitates the imparting of backspin thereto by the golfer and which has improved aerodynamic characteristics for achieving a greater overall distance of ball travel.

Other objects of the invention will become apparent from the following description taken in connection with the accompanying drawings.

DETAILED DESCRIPTION OF THE INVENTION

Figure 1:
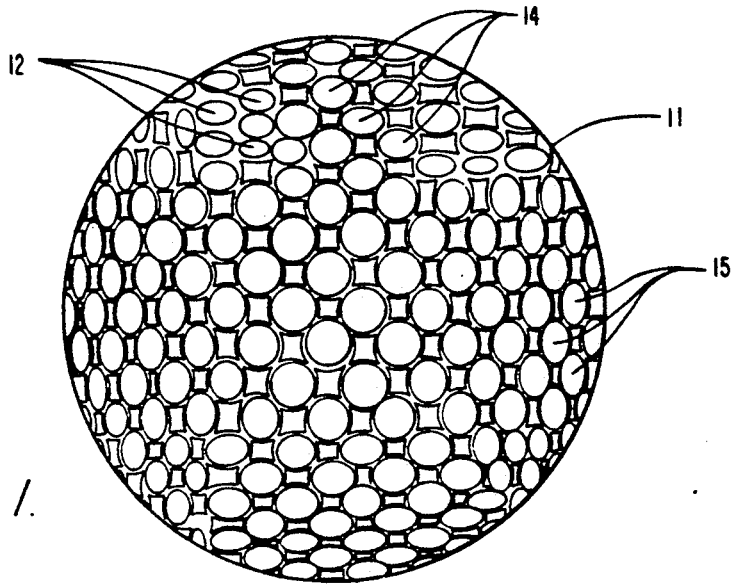
FIG. 1 is a side elevational view of a preferred embodiment of the invention.
Figure 2:
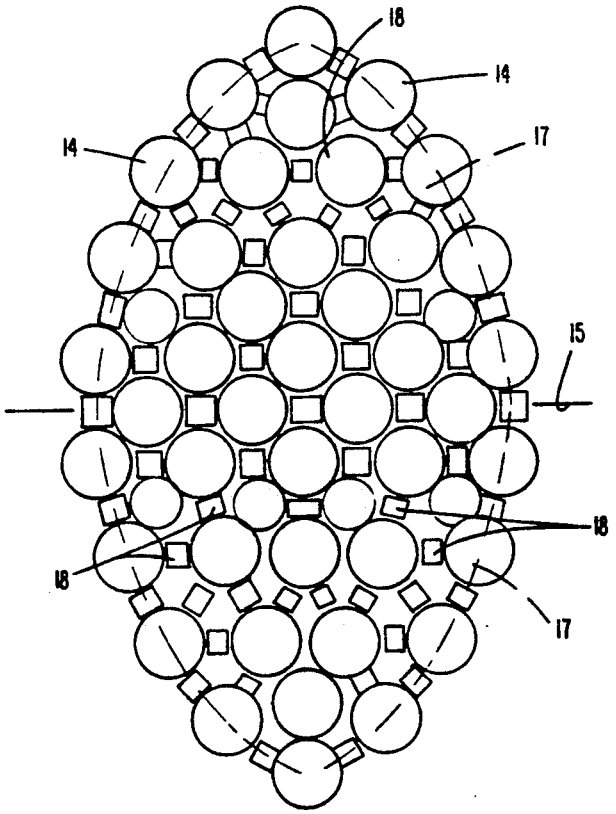
FIG. 2 is a diagrammatic view of the preferred embodiment illustrating segments of the ball surface.

Referring now to the FIGS, a preferred embodiment of the invention is shown.

Golf ball 11 has a plurality of dimples 12 formed in the surface thereof. Such dimples are arranged in a first group 14 of substantially parallel circles of alternate round and square dimples and a second group 15 of substantially parallel circles of alternate round and square dimples with the circles of group 14 being substantially perpendicular to the circles of group 15.

The circle pattern formed by groups of dimples 14 and 15 cover most of the surface of the ball. However, in the interests of completely covering such surface, several discontinuities in this pattern occur. If we divide the surface of the ball into eight similar spherical triangles 17 the sides of which are formed by portions of circles 14 and 15, circular and/or square clusters 18 of such dimples constituting such discontinuities are located in the centers of such triangles. As can be seen, the sides of the square dimples are in straight lines to provide a square impact surface areas for the club head so as to facilitate imparting backspin to the ball. The dimple pattern on the side of the ball opposite to that shown is the same as that illustrated.

While in the preferred embodiment the dimples constitute uniformly interspersed round and square dimples, other straight sided dimples can be used in lieu of the square dimples such as triangular, or other multi straight sided figures.

In the preferred embodiment 432 dimples, which has found to be an optimum number, are employed. However, other numbers of dimples may be employed to suit other design considerations compatible with the objects of the present invention.

While the invention has been described and illustrated in detail, it is to be clearly understood that this is intended by way of illustration and example only and is not to be taken by way of limitation, the scope of the invention being limited only by the terms of the following claims.

I claim:

1. A golf ball having dimples formed on the surface thereof, said dimples being arranged in a pattern comprising:

a first group of substantially parallel circles of alternate round and square dimples, and a second group of substantially parallel circles of alternate round and square dimples, the circles of said second group being substantially perpendicular to the circles of said first group, said round and square dimples causing substantially the entire surface of said golf ball.

2. The gold ball of claim 1 wherein said golf ball has approximately 432 dimples.

3. The golf ball of claim 1 wherein the surface of the ball is divided into eight similar spherical triangles the sides which are formed by portions of said circles, there being additional cluster of round and square dimples located substantially in the centers of said triangles.

* * * * *